US005625525A

United States Patent [19]

Coakley et al.

[11] Patent Number: 5,625,525

[45] Date of Patent: Apr. 29, 1997

[54] PORTABLE ELECTROMAGNETIC STUN DEVICE AND METHOD

[75] Inventors: Peter G. Coakley, Cardiff; Norbert C. Wild, Jr., San Diego, both of Calif.

[73] Assignee: Jaycor, San Diego, Calif.

[21] Appl. No.: 273,571

[22] Filed: Jul. 11, 1994

[51] Int. Cl.[6] ..... F41B 15/04

[52] U.S. Cl. ..... 361/232; 361/235

[58] Field of Search ..... 361/225, 228, 361/230, 232, 235; 89/1.11; 273/84 ES

[56] References Cited

U.S. PATENT DOCUMENTS

| | | | |
|---|---|---|---|
| 3,374,708 | 3/1968 | Wall | 89/1.11 |
| 3,626,626 | 12/1971 | Blanc | 43/6 |
| 4,167,036 | 9/1979 | Kenney | 361/232 X |
| 4,691,264 | 9/1987 | Schaffhauser | 361/232 |
| 4,846,044 | 7/1989 | Lahr | 89/1.11 |
| 4,930,392 | 6/1990 | Wilson | 89/1.11 |
| 5,103,366 | 4/1992 | Battochi | 361/232 |
| 5,193,048 | 3/1993 | Kaufman et al. | 361/232 |

*Primary Examiner*—Fritz M. Fleming

*Attorney, Agent, or Firm*—Fitch, Even, Tabin & Flannery

[57] ABSTRACT

A device and method for stunning a human or other living animal employs a nozzle or other such means through which a conductive fluid stream can be discharged toward the living animal; a current supply that is electrically coupled to the conductive fluid stream; and a grounding conductor that is coupled between the current supply and a ground potential. When the conductive fluid stream is discharged toward the human or other living animal and impacts the human or other living animal, the current supply passes a current through the human or other living animal when the human or other living animal becomes electrically coupled between the conductive fluid stream and the ground potential. The current is of sufficient magnitude to stun the human or other living animal. As a result, the human or other living animal is stunned when impacted with the conductive fluid stream.

10 Claims, 2 Drawing Sheets

PORTABLE ELECTROMAGNETIC STUN DEVICE AND METHOD

BACKGROUND OF THE INVENTION

The present invention relates to the stunning of living animals, and more particularly to the stunning of humans, or other living animals, using electromagnetic current. Even more particularly, the present invention relates to the stunning of humans, or other living animals, by contacting the humans with an electrically conductive fluid stream that carries an electromagnetic current.

There is a need in the field of law enforcement, and related areas such as personal defense, to subdue an attacker, e.g., a human attacker. Such subduing, or stunning, can be either lethal or non-lethal, but of particular interest are means of non-lethal stunning. One device for stunning an attacher is known as a stun gun. Stun guns employ two electrodes that must be placed against the attacker. Once so placed, a current is passed between the electrodes so as to stun, or at the least inflict pain upon, the attacker. Unfortunately, use of the stun gun requires that the user get close enough to the attacker to place the electrodes against the attacker. Problematically, the attacker generally has the time and opportunity to harm the user before the stun gun's stunning electrical current can be injected into the attacker.

Another attempt to address the need for the stunning of an attacker is embodied in a device sold under the trade name TASER. The TASER weapon employs two darts that are ejected from a pistol-like weapon so as to impale the attacker. Each of the darts remains coupled to the pistol-like weapon by a respective electrically conductive wire, which is used to carry a stunning current to or from the dart to which it is attached. The TASER weapon offers the benefit that the user does not need to get closer than about 5 or 6 feet from the attacker before the darts are discharged and the stunning current is delivered. Problematically however, if the user misses the attacker with one or both of the darts, the TASER weapon is unable to deliver the stunning current. Furthermore, the TASER weapon is unable to rapidly re-fire the darts. Thus, upon missing the attacker with one or both of the darts, the user is forced to flee the attacker or use less desirable means of terminating the attacker's attack, e.g., shooting the attacker with a conventional firearm or engaging the attacker in hand-to-hand combat.

A further attempt to address the need for stunning an attacker is shown in U.S. Pat. No. 5,103,366 issued to Battochi, incorporated herein by reference. The '366 patent discloses a pistol-like weapon that contains two reservoirs of conductive fluid. The reservoirs are coupled to respective outputs of a d.c. current supply that is capable of delivering a stunning current. When fired, the device shown in the '366 patent discharges two streams of the conductive fluid, which impact against the attacker. Advantageously, if the user misses the attacker, the device can be refired until the reservoirs are exhausted of useable conductive fluid. Unfortunately, if the attacker is wearing heavy clothing, e.g., a jacket, the conductive fluid from the streams may mix on the surface of the jacket, thereby completing an electrical circuit that shorts the device, and may not deliver a stunning current to the attacker. Furthermore, if the attacker is moving, and the user is attempting to follow the attacker with the streams, the streams may cross one another and short out the device.

Thus, significant needs remain unaddressed by the heretofore known devices and methods for electrically stunning a human, or other animal. The present invention advantageously addresses these and other needs.

SUMMARY OF THE INVENTION

The present invention advantageously addresses the needs above as well as other needs by providing a device and method for stunning a human being other living animal. Such stunning is achieved by contacting the human with an electrically conductive fluid stream that carries an electromagnetic current.

The present invention may be characterized as a device for stunning a living animal including a nozzle through which a conductive fluid stream can be discharged toward the living animal; a current supply that is electrically coupled to the conductive fluid stream; and a grounding conductor that is coupled between the current supply and a ground potential. The current supply passes a current through the living animal in the event the living animal is electrically coupled between the conductive fluid stream and the ground potential. The current is of sufficient magnitude to stun the living animal. Thus, the living animal is stunned when the living animal is electrically coupled between the fluid stream and the ground potential.

The present invention may also be characterized as a method of stunning a living animal including: (a) grounding a current supply to an earth ground; and (b) contacting the living animal with a conductive fluid stream that is coupled to the current supply. The method next includes (c) passing a current from the current supply through the conductive fluid stream to the living animal, and from the living animal through the earth ground to the current supply. The passing of the current causes the stunning of the living animal.

It is therefore a feature of the invention to stun a human or other living animal by contacting the human with a stream of conductive fluid.

It is another feature of the invention to stun a human or other living animal by coupling a charge supply to earth ground, i.e., ground potential.

It is a further feature of the invention to stun a human or other living animal without the need for close contact with the human or other living animal.

It is an additional feature of the invention to stun a human or other living animal without the need for electrically conductive wires that are coupled to the human or other living animal.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description of the presently contemplated best mode of practicing the invention is not to be taken in a limiting sense, but is made merely for the purpose of describing the general principles of the invention. The scope of the invention should be determined with reference to the claims.

Figure 1:
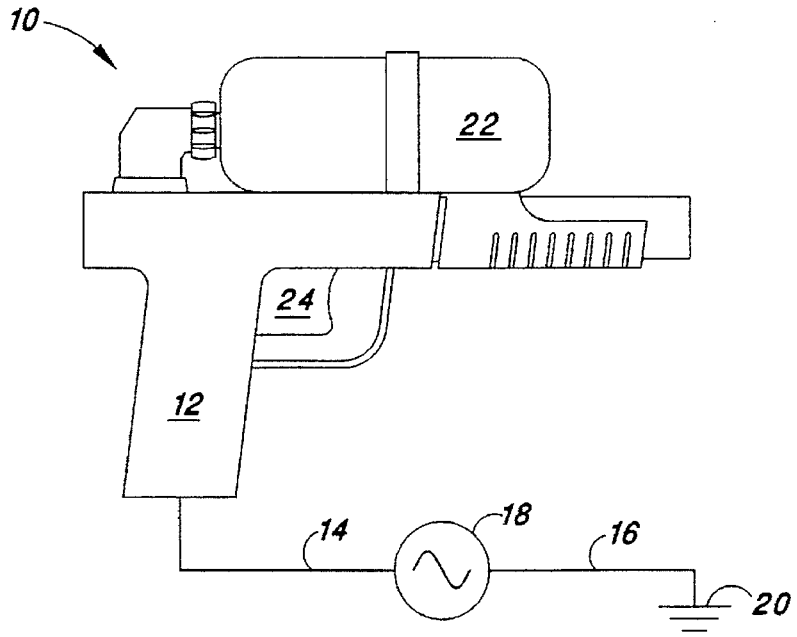
FIG. 1 is a side view of a pistol-type housing suitable for use with the present invention.

Referring first to FIG. 1, a side view is shown of a pistol-type housing 10 suitable for use with the present invention. The housing 10 includes a grip 12, from which an electrical connections 14 extends. The electrical connection 14 is coupled to an alternating current source 18. A second electrical connection 16 of the current source 18 is a grounding strap that is coupled to earth ground 20, the reasons for which are explained more fully below.

Figure 2:
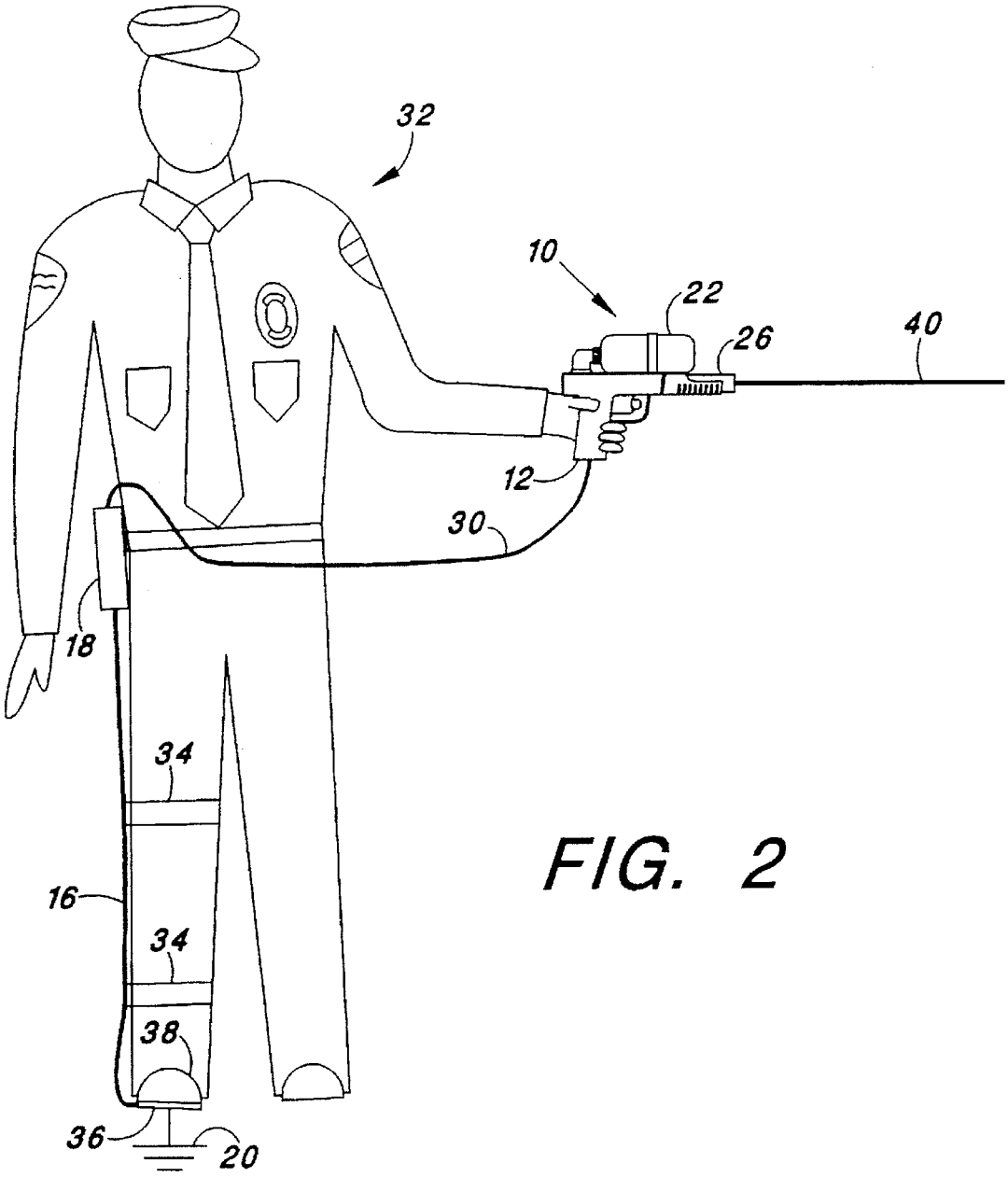
FIG. 2 is a front view of a user outfitted with a device made in accordance with the present invention, where the device includes the pistol-type housing of FIG. 1.

The current source 18 is electrically coupled within the housing 10 to a conductive fluid conduit, which effectively forms part of the barrel of the pistol like housing 10. The conductive fluid is contained under pressure in a fluid reservoir 22 atop the housing 10. When a trigger 24 is depressed, the fluid under pressure is released into the fluid conduit, thereby electrically coupling the fluid to the current source. The fluid next flows from the fluid conduit into a nozzle 26 and is discharged from the housing 10 in a stream 40 (FIG. 2). The current is an alternating current of at least 1 milliampere and having a frequency of at least 500 kHz, e.g., 1 MHz. The voltage across the current source 18 is at least 15 kV, e.g., 120 kV.

The nozzle 26 is designed so as to discharge the fluid stream in a substantially unbroken stream, i.e., a stream that is not broken into droplets. For example, the nozzle can be a smooth tapered nozzle. Furthermore, by mixing the conductive liquid to have a low surface tension, it does not break into drops as easily as if it had a high surface tension. A wetting solution is preferably added to a saltwater solution to achieve a relatively low surface tension in the conductive fluid. The saltwater solution is designed to have a resistivity of 25 Ω-cm.

Note that in an alternative embodiment, the housing 10 can be scaled up and mounted on a vehicle for the purpose of crowd dispersion, i.e., for stunning a large number of attackers (targets).

Referring to FIG. 2, a front view is shown of a user 32 outfitted with a device made in accordance with the present invention. The pistol-type housing 10 is shown coupled to the current supply 18 by a power cable 30. The current supply 18 is carried by a user 32 of the device, preferably attached to his or her belt. A grounding strap 16 is coupled to the current supply 18 and is secured to the user's leg with suitable cloth straps 34, e.g., elastic straps, or nylon web compression straps. The grounding strap 16 runs down the user's leg and is coupled to a grounding plate 36, which is secured to the bottom of the user's shoe 38. In this way, the current supply 18 remains grounded so long as the grounding plate 36 remains against the earth, i.e., so long as the user 32 has the shoe 38 against the ground 20.

In operation, when the user 32 depresses the trigger 24, the conductive fluid is discharged in the stream 40. If the attacker, or target, is in contact with the ground, an electrical circuit is completed as soon as the attacker is hit by the fluid stream 40. When the circuit is completed, current from the current supply 18 flows from the current supply 18, through the power cable 30 to the pistol-type housing 10. Within the pistol-type housing, the current flows to the fluid conduit, where it is coupled to the conductive fluid. The current follows the conductive fluid out through the nozzle 26 to the attacker, and flows through the attacker's body to ground 10. The current returns to the current supply through the ground 12, to the grounding plate 36, and through the grounding strap 16 back to the current supply. In this way a stunning electrical current is delivered to the attacker using a single stream of the conductive fluid.

Figure 3:
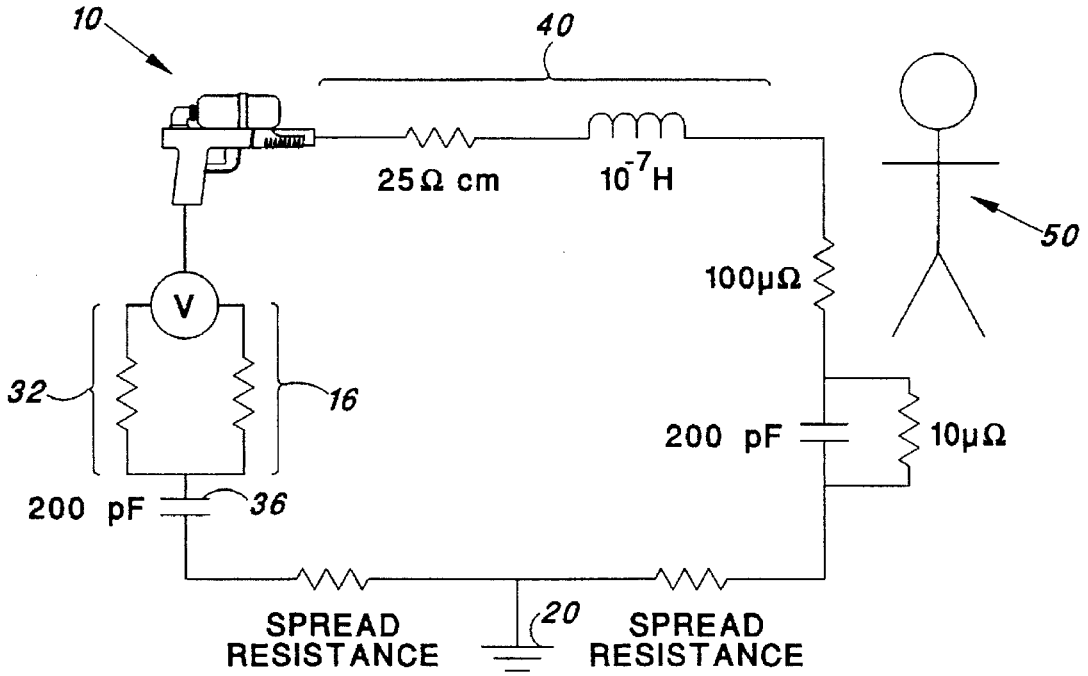
FIG. 3 is a schematic electrical diagram, including the user and the device of FIG. 2, and shows how the electrical circuit is completed when the present invention is fired at, and impacts upon, a human attacker.

Referring next to FIG. 3, a schematic diagram is shown of the electrical circuit, that is created through use of the device of FIG. 2. The electrical circuit shown in FIG. 3 is completed when the conductive fluid stream 40 is fired at, and impacts upon, an attacker, e.g., a human attacker 50.

In practice, the fluid stream 40 has a low resistance of about 25 Ω-cm times its length divided by its cross-sectional area. The fluid stream 40 also has an inductive impedance of about $10^{-7}$ H, which means the total inductive impedance is on the order of 1 Ω at the preferred frequency of about 1 MHz, and the total overall impedance of the stream 40 is predominantly resistive (e.g., about 5 KΩ for a 2 m length stream having a unit cross-sectional area). After the current passes through the fluid stream, it is coupled to the attacker 50. The attacker's body has a resistance of about 100 kΩ, which means that a more significant voltage drop will occur across the attacker 50 than occurs along the fluid stream (assuming a fluid stream is reasonably short, e.g., 2 m, and the fluid stream's cross sectional area is reasonably large, 1 $cm^2$. The current next passes to the attacker's shoes, which have a resistance of about 10 MΩ. The attacker has a coupling capacitance of about 200 pF between the attacker and ground. The ground 20, has some spread resistance, e.g., a few hundred ohms.

Next, the current passes from the ground into the grounding plate 36. The grounding plate offers very little resistance to the current's flow, but does have a coupling capacitance of about 200 pF. The current then passes through the user 32 and the grounding strap 16. The grounding strap 16 has a much lower resistance than the user 32, and therefore the current division between the grounding strap 16 and the user 32 dictates that most all of the current returns to the current supply via the grounding strap 16, instead of the user 32. In this way a circuit is completed with the attacker being a major resistance in the circuit. As such the attacker is responsible for most of the voltage drop through the circuit, and is therefore subjected to a relatively high voltage. The resistance of the conductive fluid stream should be less than or equal to the resistance of the attacker. Furthermore, the attacker 50 is subjected to the resulting current flow, which results in him or her being stunned (either lethally or non-lethally).

The use of electrically conductive fluid streams to establish electrical communication is also described in co-pending patent application Ser. No. 08/273,560, filed concurrently herewith (Atty. Docket No. 56057), entitled Electromagnetic Vehicle Arrestor System and Method, which application is assigned to the same assignee as the present application and is incorporated herein by reference.

While the invention herein disclosed has been described by means of specific embodiments and applications thereof, numerous modifications and variations could be made thereto by those skilled in the art without departing from the scope of the invention set forth in the claims.

What is claimed is:

1. A method of stunning a living animal, including:

grounding a current supply to an earth ground, the grounding of the conductor including:

coupling a grounding plate to the earth ground; and coupling the grounding plate to the current supply;

contacting the living animal with a conductive fluid stream, the conductive fluid stream being coupled to the current supply; and passing a current from the current supply through the conductive fluid stream to the living animal, and from the living animal through the earth ground to the current supply.

2. The method of claim 1 wherein said contacting includes:

depressing a trigger; and discharging said conductive fluid stream in response to the triggering.

3. The method of claim 2 wherein said passing includes:

activating said current supply to pass said current in response to said triggering.

4. A device for stunning a living animal, the device including:

a nozzle through which a conductive fluid stream can be discharged toward the living animal;

a current supply that is electrically coupled to the conductive fluid stream; and a grounding conductor that is coupled between the current supply and a ground potential, the current supply passing a current through the living animal in the event the living animal is electrically coupled between the conductive fluid stream and the ground potential, the current stunning the living animal, the grounding conductor including:

a grounding plate attachable to the bottom of a shoe; and a grounding strap coupleable between the grounding plate and said current supply;

whereby the living animal is stunned when the living animal is electrically coupled between the fluid stream and the ground potential.

5. The device of claim 4, including:

a trigger coupled to said nozzle, said nozzle discharging said conductive fluid stream in the event the trigger is depressed.

6. The device of claim 5, including:

a pistol-shaped housing that is coupled to said nozzle, and to said trigger.

7. A device for stunning a living animal including:

a current supply;

means for grounding the current supply to an earth ground, said means for grounding being coupled to the current supply;

means for contacting the living animal with a conductive fluid stream, the conductive fluid stream being coupled to the current supply; and means for passing a current from the current supply through the conductive fluid stream to the living animal, and from the living animal through the earth ground to the current supply.

8. The device of claim 7 wherein said current is an alternating current having a frequency of at least 500 kHz.

9. A device for stunning a living animal, the device including:

a nozzle through which a conductive fluid stream can be discharged toward the living animal;

a current supply that is electrically coupled to the conductive fluid stream;

a grounding conductor that is coupled between the current supply and a ground potential, the current supply passing a current through the living animal in the event the living animal is electrically coupled between the conductive fluid stream and the ground potential, the current stunning the living animal, said grounding conductor includes:

a grounding plate that can be attached to a bottom of a shoe; and a grounding strap coupled between the grounding plate and said current supply;

a trigger coupled to the nozzle the nozzle discharging the conductive fluid stream in the event the trigger is depressed;

a pistol-shaped housing that is coupled to the nozzle, and to the trigger; and a fluid reservoir coupled to the pistol-shaped housing, the fluid reservoir holding a supply of conductive fluid, the supply being under pressure;

whereby the living animal is stunned when the living animal is electrically coupled between the fluid stream and the ground potential.

10. A method of stunning a living animal including:

grounding a current supply to an earth ground, said grounding of said conductor includes:

coupling a grounding plate to said earth ground; and coupling the grounding plate to said current supply using a grounding strap;

contacting the living animal with a conductive fluid stream, the conductive fluid stream being coupled to the current supply, said contacting includes:

depressing a trigger; and discharging said conductive fluid stream in response to the depressing, said discharging includes:

releasing said conductive fluid stream from a pressurized fluid reservoir, and passing a current from the current supply through the conductive fluid stream being coupled to the current supply, said passing includes:

activating said current supply to pass said current in response to said triggering.

* * * * *